US005314787A

United States Patent [19]

Elsaesser et al.

[11] Patent Number: 5,314,787

[45] Date of Patent: May 24, 1994

[54] PROCESS FOR TREATING LITHOGRAPHIC PRINTING FORMS AND LITHOGRAPHIC PRINTING FORMS PRODUCED THEREBY

[75] Inventors: Andreas Elsaesser, Idstein; Michael Brenk, Wiesbaden, both of Fed. Rep. of Germany

[73] Assignee: Hoechst Aktiengesellschaft, Frankfurt am Main, Fed. Rep. of Germany

[21] Appl. No.: 952,092

[22] Filed: Sep. 28, 1992

[30] Foreign Application Priority Data

Oct. 16, 1991 [DE] Fed. Rep. of Germany ..... 4134143

[51] Int. Cl.[5] ..... B41N 1/08

[52] U.S. Cl. ..... 430/302; 430/18; 430/278; 430/309; 101/463.1; 101/454; 101/456; 101/467

[58] Field of Search ..... 430/302, 309, 18, 278; 101/463.1, 467, 454, 456

[56] References Cited

U.S. PATENT DOCUMENTS 4,427,765 1/1984 Mohr et al. ..... 430/278
4,983,497 1/1991 Gilson et al. ..... 430/278

FOREIGN PATENT DOCUMENTS 0069320 1/1983 European Pat. Off. .
0154200 9/1985 European Pat. Off. .
0218160 4/1987 European Pat. Off. .

*Primary Examiner*—John Kight, III
*Assistant Examiner*—John M. Cooney, Jr.
*Attorney, Agent, or Firm*—Foley & Lardner

[57] ABSTRACT

Grained, anodized and hydrophilized lithographic printing plates which have a negative or positive working radiation-sensitive coating, are exposed and are developed in an aqueous alkaline solution, are subjected, after hydrophilization, to a treatment with a salt solution containing divalent or polyvalent cations in a concentration of not less than 0.02 mol/l, thereby minimizing degradation of the plate and contamination of the printing forms and the development apparatus.

21 Claims, No Drawings

PROCESS FOR TREATING LITHOGRAPHIC PRINTING FORMS AND LITHOGRAPHIC PRINTING FORMS PRODUCED THEREBY

BACKGROUND OF THE INVENTION

The invention relates to a process for producing lithographic printing forms from grained, anodized and hydrophilized lithographic printing plates which have a radiation-sensitive coating, are exposed and are developed in an aqueous alkaline solution, and to lithographic printing forms produced thereby.

The presensitized lithographic printing forms generally used in the field are metal, usually aluminum, bases in strip, plate or sheet form which are provided with positive- or negative-working radiation-sensitive The following radiation-sensitive coatings are normally used to coat the printing plates:

positive- or negative-working diazo compounds, negative-working mixtures composed of olefinically unsaturated compounds and photoinitiators, and positive-working mixtures with photosemiconductors.

As film formers, these coatings contain polymers having functional units which ensure the development of the coatings after the imagewise exposure and optional further processing steps, such as heat treatment or toning, in the aqueous alkaline developer solutions. Examples of such functional units are —COOH, —$SO_3H$, —$PO_3H_2$, —SH, —OH and —$NH_2$.

As alkaline components, the developer solutions generally contain, in addition to further constituents, such as surfactants, hydrotropes, solvents, complexing agents etc., alkali-metal silicates. Silicates have the advantage that they attack the $Al_2O_3$ layer built up in the anodizing step on the surface of the base to a markedly lesser extent than other alkaline reagents.

Nevertheless, problems occur in practice, and specifically, of a type, in particular, which is such that the $Al_2O_3$ formed on the front and back of the aluminum base is subject to a degradation in the development process which is in some cases severe. On the back of the aluminum base, in particular, which has only a relatively thin oxide coating, this results in a gelatinous coating which accumulates on the squeeze rollers of the development apparatus and may be retransferred from that point to the developed lithographic printing forms. In order to avoid the malfunctions in the printing process resulting therefrom, prevention of this contamination by regular cleaning of the development apparatus is therefore necessary.

SUMMARY OF THE INVENTION

An object of the invention Is to improve a process of the type described at the outset in such a way that the degradation of the oxide coating on the front and back of the metal, generally aluminum, carrier and the contaminations of the printing forms and of the development apparatus caused thereby are avoided or effectively reduced.

It is further an object of the present invention, to provide a printing plate which has minimal degradation during the development phase, of the metal oxide, generally aluminum oxide, formed during the anodization.

In accomplishing the foregoing objectives, there has been provided in accordance with a first aspect of the invention, a process for treating grained, anodized and hydrophilized lithographic printing plates so as to reduce the amount of degradation of the metal oxide layer formed during the anodization, comprising the step of treating the plate with a salt solution containing divalent or polyvalent cations in a concentration of not less than 0.02 mol/l.

In accordance with a further object of the present invention, there has been provided a printing form produced by the above method.

Further objects, features, and advantages of the present invention will become apparent from the detailed description of preferred embodiments which follows.

DETAILED DESCRIPTION OF THE PREFERRED EMBODIMENTS

According to the invention the front and/or the back of the lithographic printing plates are treated after hydrophilization with a salt solution containing divalent or polyvalent cations in a concentration of not less than 0.02 mol/l. The front side is the side of the plate which is coated with a radiation-sensitive mixture.

Cation concentrations below 0.02 mol/l (such as are present, for example, in hard water) are not sufficiently effective in improving the resistance of the anodized layer to alkali. The preferred concentration range is between 0.04 and 0.4 mol/l.

Any cation or mixture of cations can be used in the process. As particularly suitable cations, mention is made of the divalent or trivalent ions of the elements of the second and third main groups, e.g. Mg, Ca, Al, and of the third subgroup, e.g. Sc, Y, of the periodic system. However, the divalent or trivalent cations of V, Cr, Mn, Fe, Co, Ni, Zn, Sn and Pb are also effective.

In principle, suitable anions associated with the cations are both inorganic and organic monovalent and polyvalent anions, the choice being governed, in particular, by the solubility of the corresponding salts.

The treatment of the front and/or back of the aluminum carrier with the salt solution is carried out such that the degradation of the oxide coatings on the printing forms is reduced during development. Any treatment conditions giving this desired effect can be used. Preferably the treatment is carried out at a temperature between 20° and 90° C. for times between 1 second and 1 minute.

The salt solution is applied by means of any standard technique, for example spraying, rinsing or immersing, most conveniently after the hydrophilization of the front and before the deposition of the photosensitive coating. The back may be rinsed at the same time as the front, but can also be rinsed with the salt solution after the deposition of the photosensitive coating. Drying after treatment with the salt solution at temperatures between 50° and 250° C. is often advantageous.

For the other steps in the treatment of the surface of the base, such as pickling, graining, intermediate pickling, hydrophilization, and anodization, any known processes can be used. That is, the inventive salt solution treatment can be used on any metal substrate which has been grained, anodized and hydrophilized. Preferred processes are described in the following examples.

The radiation-sensitive coatings applied to the plates can be any known in the art. Any known development technique using an alkaline developer can be used to develop the coating.

The advantage of the process and of the lithographic printing forms produced thereby is that the treatment with the salt solution suppresses the attack of the aqueous alkaline developer solution on the oxide layer on the front and back of the carrier material.

The invention is demonstrated by the following examples without being limited thereby.

1. Examples of the treatment of the oxide layer with various salt solutions at the same temperature after hydrophilization A bright-rolled 0.3 mm thick aluminum strip is pickled in NaOH, electrolytically grained in hydrochloric acid (Rz value as defined in DIN 4768: 5.0 μm), anodized in sulfuric acid (oxide weight on the front 4.0 g/m$^2$, at the edge of the back 1.7 g/m$^2$, and in the center of the back 0.3 g/m$^2$), and hydrophilized with polyvinylphosphonic acid solution in accordance with DE-B 16 21 478. Thereafter the aluminum strip is sprayed with various 0.02 to 0.4 molar salt solutions for 1 to 60 s at 20° to 90° C., preferably with a 0.04 molar salt solution as set forth in Table 1 for 10 s at 25° C. for each example, and it is then coated with a photoresist solution containing the following constituents:

a) a cresol-formaldehyde novolak resin,
b) an esterification product of a (1,2-naphthoquinone 2-diazide)-4- or -5-sulfonyl chloride with a phenol derivative,
c) a compound which forms a strong acid on irradiation,
d) a cationic dye, and
e) a solvent or solvent mixture having a boiling point of less than 200° C.

In the examples, the photoresist solution particularly contains the following constituents:

5.00% by weight of a cresol-formaldehyde novolak resin having a hydroxyl number of 420 as defined in DIN 53 783/53 240 and a weight-average molecular weight (Mw) determined by GPC of 10,000 (polystyrene standard),
1.20% by weight of the esterification product of 3 mol of (1,2-naphthoquinone 2-diazide)-5-sulfonyl chloride and 1 mol of 2,3,4-trihydroxybenzophenone,
0.15% by weight of (1,2-naphthoquinone 2-diazide)-4-sulfonyl chloride,
0.05% by weight of Victoria pure blue (C.I. 44 045), and
93.60% by weight of a solvent mixture composed of methyl ethyl ketone and propylene glycol monomethyl ether (40/60 weight ratio).

The photoresist film is dried for one minute at 125.C. The film weight is 1 to 3 g/m$^2$, in particular 2.4 g/m$^2$ in this example.

The presensitized lithographic printing plates are processed to produce printing forms. In a vacuum contact copying frame, the plates are brought into contact with a test image by evacuation and exposed using a 5 kW metal-halide-doped mercury-vapor lamp at a distance of 110 cm so as to result, after development, in a clear step 4 in the UGRA offset test wedge, which corresponds to a high-intensity film edge elimination exposure.

Thereafter development is carried out for one minute at 25° C. in a development apparatus (VA 86 supplied by Hoechst AG) using a potassium silicate developer having a total alkali-metal content of 0.95 mol/l.

The extent to which the development process results in a degradation of the oxide layer of the base material is assessed by visual inspection. Visually, the degradation reveals itself in the form of a white, striated coating on the back of the carrier material. The results are shown in Table 1.

The rating system in Table 1 below is as follows:

(+)=strong oxide degradation
(0)=slight oxide degradation (i.e. especially in the edge region of the back)
(−)=oxide degradation not detectable

TABLE 1

| | Salt | Rating |
|---|---|---|
| Examples | | |
| 1-1 | $MgCl_2$ | − |
| 1-2 | $Mg(NO_3)_2$ | − |
| 1-3 | $CaCl_2$ | − |
| 1-4 | $Ca(NO_3)_2$ | − |
| 1-5 | Ca acetate | − |
| 1-6 | $SrCl_2$ | − |
| 1-7 | Sr laevulinate | − |
| 1-8 | $BaCl_2$ | − |
| 1-9 | $Ba(NO_3)_2$ | − |
| 1-10 | $ScCl_3$ | − |
| 1-11 | $Sc_2(SO_4)_3$ | − |
| 1-12 | $LaCl_3$ | − |
| 1-13 | $La(NO_3)_3$ | − |
| 1-14 | $TiCl_3$ | − |
| 1-15 | $VSO_4$ | − |
| 1-16 | $CrCl_2$ | − |
| 1-17 | $MnBr_2$ | − |
| 1-18 | $NiCl_2$ | − |
| 1-19 | $CuCl_2$ | − |
| 1-20 | $ZnSO_4$ | − |
| 1-21 | $AlCl_3$ | − |
| 1-22 | $SnCl_2$ | − |
| 1-23 | Pb acetate | − |
| Comparison Examples | | |
| 1-24 | no rinsing | + |
| 1-25 | fully demineralized water only | + |

2. Examples of the treatment of the oxide layer with the same salt solution at various temperatures after hydrophilization A 0.3 mm thick aluminum foil which has been electrolytically grained in nitric acid (Rz value as defined in DIN 4768: 3.2 μm) and anodized in sulfuric acid (oxide weight on the front 2.0 g/m$^2$, at the edge of the back 1.2 g/m$^2$, and in the center of the back 0.2 g/m$^2$) is hydrophilized with polyvinylphosphonic acid in accordance with DE-B 16 21 478, immersed for to 60 s at various temperatures as seen in Table 2 in a Ca salt solution containing more than 0.02 mol/1, for example in a 0.15 molar $CaCl_2$ solution for 10 s at the temperatures as set forth in Table II for each example, dried for 15 s at 120° C. and then coated with a photoresist solution containing the following constituents:

a) a cresol-formaldehyde novolak resin,
b) an esterification product of a (1,2-naphthoquinone 2-diazide)-4- or -5-sulfonyl chloride with a phenol derivative,
c) a compound which forms a strong acid on irradiation,
d) a cationic dye,
e) a silica filler having a mean particle size of 3 to 5 μm,
f) a surfactant based on dimethylsiloxane and ethylene oxide units, and
g) a solvent or solvent mixture having a boiling point of less than 200° C.

In the examples, the photoresist solution particularly contains the following constituents:

4.80% by weight of a cresol-formaldehyde novolak resin having a hydroxyl number of 420 as defined in DIN 53 783/53 240 and a weight-average molecular weight (Mw) determined by GPC of 10,000 (polystyrene standard),
1.05% by weight of an esterification product of 3 mol of (1,2-naphthoquinone 2-diazide)-4-sulfonyl chloride and 1 mol of 2,3,4-trihydroxybenzophenone, 0.05% by weight of 2-(4-styrylphenyl)4,6-bis-trichloromethyl-s-triazine,
0.10% of crystal violet (C.I. 42 555),
1.00% by weight of silica filler having a mean particle size of 3.9 μm,
0.10% by weight of surfactant based on dimethylsiloxane and ethylene oxide units, and
92.90% by weight of a solvent mixture composed of tetrahydrofuran and propylene glycol monomethyl ether (55/45 weight ratio).

The photoresist film is dried for one minute at 125° C. The film weight is 1.8 g/m$^2$.

The processing of the finished lithographic printing plates with a reversible positive layer is carried out as follows:

exposure in a copying frame as in the examples in Section 1) through a test master for 60 s,
heat treatment for 1 minute at 135° C. in a continuous oven,
cooling by circulating air cooling for 10 s,
flood exposure without master using UV-A fluorescent lamps having a radiant power of 240 watts for 30 s in a continuous apparatus,
development in an apparatus as in the examples in Section 1) with a printing plate processing speed of 0.5 m/min.

For the purpose of development, use is made of a potassium silicate developer according to DE-A 40 27 299 having a total alkali-metal content of 1.3 mol/l and a polyglycol-1000-dicarboxylic acid content of 0.6% by weight.

In addition to the oxide degradation criterion, which is rated as in the examples in Section 1), the copying technique behavior, i.e., photosensitivity, reproduction, color haze, side lighting susceptibility, and the printing behavior, i.e, running clean, water demand, print run, of the lithographic printing plates manufactured int his way are investigated. The results are shown in Table 2.

TABLE 2

| | Temperature in °C. | Oxide degradation | Copying/printing behavior |
|---|---|---|---|
| Examples | | | |
| 2-1 | 20 | – | no disadvantages compared with standard |
| 2-2 | 30 | – | no disadvantages compared with standard |
| 2-3 | 40 | – | no disadvantages compared with standard |
| 2-4 | 50 | – | no disadvantages compared with standard |
| 2-5 | 60 | – | no disadvantages compared with standard |
| 2-6 | 70 | – | no disadvantages compared with standard |
| 2-7 | 80 | – | no disadvantages compared with standard |
| 2-8 | 90 | – | no disadvantages compared with standard |
| Comparison example | | | |
| 2-9 | without rinsing | + | standard |

3. Examples of the treatment of the oxide layer with various concentrations of the same salt solution after deposition of the radiation-sensitive layer After hydrophilization, a lithographic printing plate carrier manufactured in accordance with the examples in Section 1) is coated with a solution containing the following constituents:

a) a compound containing at least one olefinic double bond,
b) a polymeric, alkali-soluble binder having an acid number greater than 10,
c) a photoinitiator,
d) a dye, and
e) a solvent or solvent mixture having a boiling point of less than 200° C.

In the example, the solution particularly contains the following constituents:

3.00% by weight of trimethylolpropane triacrylate,
10.00% by weight of a copolymer of methyl methacrylate and methacrylic acid having an acid number of 190 and a weight-average molecular weight (Mw) determined by GPC of 50,000 (polystyrene standard)
0.05% by weight of dibenzalacetone,
0.05% by weight of 9-phenylacridine,
0.10% by weight of an azo dye composed of 2,4-dinitro-6-chlorobenzenediazonium chloride and 2-methoxy-5-acetylamino-N-cyanoethyl-N-hydroxyethylaniline, and
86.80% by weight of ethylene glycol monomethyl ether.

The photoresist film is dried for two minutes at 125° C. and has a layer weight of 3.0 g/m$^2$.

Thereafter the back of the carrier foil is sprayed with Ca salt solutions at 20° to 90° C. for between 1 and 60 s, preferably with $Ca(NO_3)_2$ solutions, of various concentrations as shown in Table 3 for 10 s at a temperature of 25 ° C for each example and the following solution is then deposited on the front as an oxygen after diffusion barrier layer:

2.20 % by weight of polyvinyl alcohol which has a residual acetyl group content of 10.7% and whose 4%-strength aqueous solution has a viscosity of 8 mPas (Mowiol 8-88 supplied by Hoechst AG),
0.02% by weight of sec-sodium alkanesulfonate (Hostapur SAS supplied by Hoechst AG),
0.02% by weight of chloroacetamide, and
97.76% by weight of fully demineralized water.

After drying for 1 minute at 125° C., the barrier layer has a layer weight of 2.0 g/m$^2$.

The presensitized lithographic printing plates obtained in this way are exposed for 35 s as in the examples in Section 1) and then developed in a development apparatus as in the examples in Section 1) with a preliminary fully demineralized water rinsing of the front to remove the PVAl covering layer at a processing speed of 0.6 m/min in a potassium silicate developer having a total alkali-metal content of 0.55 mol/l and a content of nonionic wetting agent (coconut butter alcohol polyoxyethylene ether containing approximately 8 oxyethylene units (Genapol C080 supplied by Hoechst AG)) of 1 g/l.

The oxide degradation is again rated as in the examples in Section 1). The results are shown in Table 3.

TABLE 3

| | Salt concentration | Oxide degradation |
|---|---|---|
| Examples | | |
| 3-1 | 0.02 mol/l | – |

TABLE 3-continued

| | Salt concentration | Oxide degradation |
|---|---|---|
| 3-2 | 0.04 mol/l | – |
| 3-3 | 0.10 mol/l | – |
| 3-4 | 0.20 mol/l | – |
| 3-5 | 0.40 mol/l | – |
| Comparison examples | | |
| 3-6 | no rinsing | + |
| 3-7 | 0 mol/l | + |
| 3-8 | 0.001 mol/l | 0 |
| 3-9 | 0.01 mol/l | 0 |

A developer exhaustion test was carried out with a number of settings up to a loading of 3 $m^2$ of printing plates per 1 liter. In Comparison Examples 3-7, a heavy coating exhibits itself thereafter on the squeeze rollers, and in 3-8 a light coating, whereas no coating is visible in Example 3-3.

4. Electrophotographic printing form examples of treatment for various durations of the oxide layer with the same salt solution after hydrophilization A lithographic printing plate carrier processed as in the examples in Section 1) is immersed after hydrophilization in 0.02 to 0.4 molar Sr salt solution, preferably in a 0.04 molar Sr solution at a temperature of 25° C. for various times as seen in Table 4 and then coated with a solution containing the following particular constituents:

a) an organic photoconductor,
b) a polymeric, alkali-soluble binder,
c) a dye, and
d) a solvent or solvent mixture having a boiling point of less than 100° C.

In the illustrative example, the coating solution contains the following particular constituents:

5.00% by weight of 2,5-bis(4'-diethylaminophenyl)-1,3,4-oxadiazole,
5.00% by weight of cresol-formaldehyde novolak resin (corresponding to Examples in Section 1),
0.01% by weight of rhodamine FB (C.I. 45 170), and
89.99% by weight of ethylene glycol monomethyl ether.

The layers are dried for two minutes at 125° C. and have a layer weight of 5 g/$m^2$.

The lithographic printing plates manufactured in this way and working on the electrophotographic principle are charged in the dark with a Corona discharge to -500 V and exposed for 30 s in a projection apparatus comprising 8 halogen lamps of 500 watt each. The latent charge image produced is toned with the aid of a magnetic roller with a commercial toner/carrier mixture. After the toner has been heat-fixed, the non-image areas are removed with the following solution:

| | |
|---|---|
| $Na_2SiO_3$ | 2.0% by weight |
| NaOH | 0.2% by weight |
| Ethylene glycol | 15.0% by weight |
| n-Propanol | 10.0% by weight |

The extent to which the stripping process, which requires 5 minutes, results in an attack on the oxide layer of the base is investigated. The results are shown in Table 4.

TABLE 4

| Immersion time in seconds | Oxide degradation |
|---|---|
| 0 | + |
| 1 | – |
| 2 | – |
| 5 | – |
| 10 | – |
| 60 | – |

As can be inferred from Table 4, a substantial oxide degradation occurs only if the treatment with the salt solution is omitted, whereas even a very short immersion in the salt solution (1 s) suppresses the oxide degradation.

What is claimed is:

1. A process for treating grained, and anodized lithographic printing plates so as to reduce the amount of degradation of the metal oxide layer formed during the anodization, comprising the steps of hydrophilizing the plate with polyvinylphosphonic acid and treating the hydrophilized plate with a slat solution containing divalent or polyvalent cations in a concentration of not less than 0.02 mol/l, wherein the salt solution contains at least one salt selected from the group consisting of $MgCl_2$, $Mg(NO_3)_2$, $CaCl_2$, $Ca(NO_3)_2$, Ca acetate, $SrCl_2$, Sr laevulinate, $BaCl_2$, $Ba(NO_3)_2$, $ScCl_3$, $Sc_2(SO_4)_3$, $LaCl_3$, $La(NO_3)_3$, $TiCl_3$, $VSO_4$, $CrCl_2$, $MnBr_2$, $CuCl_2$, $ZnSO_4$, $AlCl_3$, $SnCl_2$, and Pb acetate.

2. A process as claimed in claim 1, further comprising the steps of coating said lithographic printing plate with a radiation-sensitive coating, exposing said coating, and developing the exposed coating with an aqueous alkaline developing solution.

3. A process as claimed in claim 2, wherein the salt solution is applied by spraying, immersing or rinsing the front of said lithographic printing plate after hydrophilizing and before depositing the radiation-sensitive coating on the front of said lithographic printing plate.

4. A process as claimed in claim 3, wherein the back of the lithographic printing plate is rinsed with the salt solution at the same time as the front.

5. A process as claimed in claim 2, wherein the back of the lithographic printing plate is rinsed with the salt solution after hydrophilization and after the deposition of the radiation-sensitive coating on the front.

6. A process as claimed in claim 1, wherein the concentration of the salt solution is in the range from 0.04 to 0.4 mol/l.

7. A process as claimed in claim 1, wherein the temperature of the salt solution is 20° to 90° C.

8. A process as claimed in claim 1, wherein the treatment time of the salt solution is between one second and one minute.

9. A process as claimed in claim 1, wherein the cation of the salt solution is an ion of an element of the second or third main group or of the third subgroup of the periodic table.

10. A process as claimed in claim 1, wherein the cation is calcium.

11. A process as claimed in claim 1, wherein the cation of the salt solution is an ion of an element selected from the group consisting of V, Cr, Mn, Fe, Co, Ni, Zn, Sn, and Pb.

12. A process as claimed in claim 2, wherein the aqueous alkaline developing solution comprises a silicate.

13. A process as claimed in claim 1, wherein the salt solution contains at least one salt selected from the group consisting of $Mg(NO_3)_2$, $CaCl_2$, $Ca(NO_3)_2$, Ca acetate, $SrCl_2$, Sr laevulinate, $BaCl_2$, $Ba(NO_3)_2$, $ScCl_3$, $Sc_2(SO_4)_3$, $LaCl_3$, $La(NO_3)_3$, $TiCl_3$, $VSO_4$, $MnBr_2$, $CuCl_2$, $ZnSO_4$, $AlCl_3$, $SnCl_2$, and Pb acetate.

14. A process as claimed in claim 2, wherein said treating comprises, before the deposition of the radiation-sensitive coating, immersing the lithographic printing plate for between 1 and 60 seconds in a more than 0.02 molar Ca salt solution at a temperature in the range from 20° to 90° C.

15. A process as claimed in claim 2, wherein said treating comprises, after the deposition of the radiation-sensitive coating, spraying the back of the lithographic printing plate for between 1 and 60 seconds at 20° to 90° C. with a Ca salt solution in the concentration range from 0.02 to 0.40 mol/l.

16. A process as claimed in claim 2, wherein said treating comprises, after hydrophilization and before deposition of the radiation-sensitive coating, immersing the lithographic printing plate for 1 to 60 seconds in a 0.02 to 0.4 molar Sr salt solution.

17. A lithographic printing form produced by a process as claimed in claim 1.

18. A lithographic printing form produced by a process as claimed in claim 2, wherein said radiation sensitive coating is a photoresist film having a film weight of 1 to 3 $g/m^3$ and wherein the photoresist film is formed by drying a photoresist solution containing the following constituents:

a) a cresol-formaldehyde
b) an esterification product of a (1,2-naphthoquinone 2-diazide)-4- or -5-sulfonyl chloride with a phenol derivative,
c) a compound which forms a strong acid on irradiation,
d) a cationic dye, and
e) a solvent or solvent mixture having a boiling point of less than 200° C.

19. A lithographic printing form produced as claimed in claim 2, wherein said radiation-sensitive coating is a photoresist film having a film weight of 1 to 3 $g/m^2$ and wherein the photoresist film is formed by drying a photoresist solution containing the following constituents:

a) a cresol-formaldehyde novolak resin,
b) an esterification product of a (1,2-naphthoquinone 2-diazide)-4- or -5-sulfonyl chloride with a phenol derivative,
c) a compound which forms a strong acid on irradiation,
d) a cationic dye,
e) a filler having a mean particle size of 3 to 5 μm,
f) a surfactant based on dimethylsiloxane and ethylene oxide units, and
g) a solvent or solvent mixture having a boiling point of less than 200° C.

20. A lithographic printing form produced by a process as claimed in claim 2, wherein said radiation sensitive coating is a photoresist film and wherein the photoresist film is formed by drying a photoresist solution containing the following constituents:

a) a compound containing at least one olefinic double bond,
b) a polymeric, alkali-soluble binder having an acid number greater than 10,
c) a photoinitiator,
d) a dye, and
e) a solvent or solvent mixture having a boiling point of less than 200° C.

21. A lithographic printing form produced by a process as claimed in claims 2, wherein said radiation-sensitive layer is a radiation-sensitive electrophotographic layer and wherein said layer is formed by drying a coating solution containing the following constituents:

a) an organic photoconductor,
b) a polymeric, alkali-soluble binder,
c) a dye, and
d) a solvent or solvent mixture having a boiling point of less than 100° C.

* * * * *

UNITED STATES PATENT AND TRADEMARK OFFICE

CERTIFICATE OF CORRECTION

PATENT NO. : 5,314,787

DATED : May 24, 1994

INVENTOR(S) : Andreas ELSAESSER et al.

It is certified that error appears in the above-indentified patent and that said Letters Patent is hereby corrected as shown below:

Column 8, line 21, claim 1, contains a typographical error wherein "slat" should read --salt--.

Column 8, line 27, claim 1, after "$MnBr_2$" insert --$NiCl_2$--;

Column 9, line 29, claim 18, after "formaldehyde" insert --novolak resin--.

Signed and Sealed this

Twentieth Day of September, 1994

*Attest:*

Bruce Lehman

BRUCE LEHMAN

*Attesting Officer*

*Commissioner of Patents and Trademarks*